US007777135B2

(12) United States Patent
Howe

(10) Patent No.: US 7,777,135 B2
(45) Date of Patent: Aug. 17, 2010

(54) CABLE AND APPARATUS FOR FORMING THE SAME

(76) Inventor: Eugene Howe, 24 Elm Ct., Highburton, Kirkburton, Huddersfield HD8 OTB (GB)

( * ) Notice: Subject to any disclaimer, the term of this patent is extended or adjusted under 35 U.S.C. 154(b) by 723 days.

(21) Appl. No.: 10/572,005

(22) PCT Filed: Sep. 13, 2004

(86) PCT No.: PCT/GB2004/003918

§ 371 (c)(1),
(2), (4) Date: Mar. 22, 2007

(87) PCT Pub. No.: WO2005/027148

PCT Pub. Date: Mar. 24, 2005

(65) Prior Publication Data

US 2007/0246239 A1 Oct. 25, 2007

(30) Foreign Application Priority Data

| | | |
|---|---|---|
| Sep. 13, 2003 | (GB) | 0321551.4 |
| Dec. 23, 2003 | (GB) | 0330004.3 |
| Apr. 27, 2004 | (GB) | 0409289.6 |
| Aug. 16, 2004 | (GB) | 0418151.7 |

(51) Int. Cl.
*H01B 7/00* (2006.01)

(52) U.S. Cl. ..... 174/113 R; 174/113 C

(58) Field of Classification Search ..... 174/110 R, 174/113 R, 113 C, 115, 116, 113 AS, 36
See application file for complete search history.

(56) References Cited

U.S. PATENT DOCUMENTS

| | | | | |
|---|---|---|---|---|
| 4,777,325 | A * | 10/1988 | Siwinski | 174/34 |
| 5,132,488 | A * | 7/1992 | Tessier et al. | 174/34 |
| 5,821,467 | A * | 10/1998 | O'Brien et al. | 174/117 F |
| 5,969,295 | A * | 10/1999 | Boucino et al. | 174/113 C |
| 6,162,992 | A * | 12/2000 | Clark et al. | 174/113 R |
| 6,218,621 | B1 * | 4/2001 | Kuczynski | 174/110 R |
| 6,222,130 | B1 * | 4/2001 | Gareis et al. | 174/113 C |
| 6,303,867 | B1 | 10/2001 | Clark et al. | |
| 6,566,607 | B1 * | 5/2003 | Walling | 174/113 R |
| 6,639,152 | B2 * | 10/2003 | Glew et al. | 174/113 C |
| 2002/0125036 | A1 * | 9/2002 | Price et al. | 174/113 R |

FOREIGN PATENT DOCUMENTS

| | | |
|---|---|---|
| EP | 1109174 A | 6/2001 |
| WO | PCT/GB2003/001005 | 3/2003 |

* cited by examiner

*Primary Examiner*—William H Mayo, III
(74) *Attorney, Agent, or Firm*—Head, Johnson & Kachigian, P.C.

(57) ABSTRACT

The invention relates to a cable and apparatus and a method for forming the same. The cable comprises a series of conductors, said conductors arranged in sets of two or more, each set having the conductors twisted with respect to each other and passing along the length of the cable encapsulated in a material which forms the body of the cable such that the conductors are integral with the cable body. The material also acts to maintain the spacing of the respective sets. In one embodiment the rigidity of the cable varies dependent on whether or not the cable is twisted. The apparatus provides for the efficient manufacture and storage of the cable.

28 Claims, 12 Drawing Sheets

FIG. A1

PRIOR ART

PRIOR ART 206
202
204
214
208
210
216
211
222

CABLE AND APPARATUS FOR FORMING THE SAME

CROSS-REFERENCE TO RELATED APPLICATION

This is a United States National Phase Application of PCT Application No. PCT/GB/2004/002918 having an international filing date of 13 Sep. 2004 which claims priority to British Application No. 0321551.4 filed 13 Sep. 2003; British Application No. 0330004.3 filed 23 Dec. 2003; British Application No. 0409289.6 filed 27 Apr. 2004; and British Application No. 0418151.7 filed 16 Aug. 2004.

STATEMENT REGARDING FEDERALLY SPONSORED RESEARCH OR DEVELOPMENT

N/A

REFERENCE TO A MICROFICHE APPENDIX

N/A

BACKGROUND OF THE INVENTION

The invention to which this application relates is to provide improvements to a configuration of a cable, said cable formed by integrating a series of conductor sets or pairs passing therealong into a cable body and the cable provided for any suitable, conventional or specialist cable usage including data transmission, audio, video energy transmissions.

The Applicant, in their co-pending Application No. PCT/GB2003/001005, discloses cables for use in a variety of fields. The improvements relate to the configuration of conductors within each conductor set and also to the configuration of the conductor sets with respect to other conductor sets passing along the cable. As will be seen from the Applicant's co-pending application, significant improvements in terms of the consistency of each conductor set and the distance apart between adjacent conductor sets, provides improvements in Near End Cross Talk (NEXT), PSNEXT, PSFEXT, ELFEXT impedance performance and return loss for example. Furthermore, the degree of twist density between conductor pairs with respect to adjacent conductor sets, allows the ability to reduce, amongst other parameters, near end cross talk between the conductor pairs such that comparison of the improved cable as defined in the Applicant's co-pending application, with conventionally available Cat-5 Cat-6 or Cat-7 cables, provided remarkable and significant improvements in performance.

In this current application, the Applicant has identified further improvements to the configuration of conductors within cables and the formation of the cables themselves and preliminary results suggest that improvements in performance when compared with the conventional cables is again achieved. It is envisaged that these improvements, as herein defined, will allow the cable to be used in areas where other cables may not be of optimum suitability and to further provide improvements.

A further problem with the use of certain configurations of conventional cable and in particular materials used to encapsulate the conductors which pass along the cable, is that the material, when formed, can be relatively rigid. While this rigidity is of benefit in certain instances, where, for example, the cable is required to be installed in a relatively straight line, the rigidity can cause problems where the cable is required to be fitted around curves or bends and a further problem is that the cable can be difficult to store in an efficient manner.

Furthermore, problems can occur in the formation of cables housing a series of conductor sets, each of said sets having at least two conductors provided in a twisted orientation. Conventionally, when forming cables of this type, the conductors in each pair are requited to be produced in an exact symmetrical manner in terms of the twist and density of twist along the length of each of the conductor pairs. If the same are not provided in a symmetrical manner, then performance issues can arise in terms of impedance, capacitance, inductance, resistance and/or return loss.

Conventionally, to construct a typical high speed balanced data cable, an initial process is used which is called twinning. This is where two insulated conductors of required size are twisted together as shown in prior art FIG. A. Conventionally, the density of twists differs from conductor set to conductor set due to the close proximity of the conductor sets when the cable is formed. This density of twist and variation in the same is provided in an attempt to reduce or minimise cross-talk between each of the conductor pairs.

The twisting of these conductor sets must be extremely accurate as any fluctuations will cause inconsistency within the cable and thus cause degradation in performance and hence the associated equipment it services. Once the twisting has been performed, the conductor sets are then wound onto separate drums from which the conductor set is subsequently fed into cable forming apparatus which allows the extrusion of the cable and the location of the conductor sets with respect to each other in the cable. In order to do this, the drums are placed into a "payoff" section at the start of the extrusion process and are fed through a convergence eyelet which allows them to pass through a die head and hence form the cable by introducing a sheath which overlies the conductor sets and forms the outer surface of the cable. It is during this process that the arrangement of the conductor sets are most vulnerable to problems as the sets are drawn or pulled off the drums and, in order to do so, force must be applied. This force causes tension to the conductor sets which, as the conductor sets are held together by the introduction of the twist, can cause the deformation and/or unravelling of the twist of the conductor sets.

BRIEF SUMMARY OF THE INVENTION

One aim of the present invention is to provide an improved cable form which allows improved adaptability of the cable and, furthermore, improved ability for efficient storage of the same. A further aim is to provide apparatus which allows the efficient manufacture of the cable and to provide a method by which the conductor sets can be formed into their twisted configuration and then maintained in that condition with a greater degree of uniformity than is conventionally possible.

In a first aspect of the invention, there is provided a cable, said cable including a plurality of conductor sets, each set including at least two conductors, said conductors in each set twisted together and wherein the respective conductor sets ate spaced apart as they pass along the length of the cable and wherein, the conductor sets are embedded within an insulating material which forms the body or wall of the cable to form an integral part of the cable body.

In one embodiment, the insulating material is extruded with the conductor sets held in respective positions as they pass through the die head as the insulating material is extruded.

Typically the conductor sets are fed through the extrusion apparatus such that the same are held in a substantially linear path and in a substantially continuous configuration along the length of the cable.

In one embodiment, in cross section, each conductor set is mounted and positioned within a limb such that a series of limbs are provided within the cable.

In a further embodiment, the respective conductor sets follow parallel paths along the length of the cable but each path is in a wave or oscillating formation along the length of the cable. In an alternative to the wave formation, each conductor set follows a spiral path along the length of the cable. These embodiments serve to reduce the possibility of alien cross talk between adjacent neighbouring cables.

In both the wave and spiral configuration, the angle and/or frequency of wave or spiral can be set with respect to the particular cable design to optimise the greatest or acceptable alien cross talk reduction.

In one embodiment, the angle of spiral or oscillation is within the range of 0.1-90° degrees but this is only one range of a number of possible ranges.

In a further embodiment of the invention, the insulating material is formed with a series of perforation lines, said perforation lines running substantially parallel with the longitudinal axis of the conductor sets and between adjacent conductor sets so as to allow, when the perforated lines are broken, a conductor set and a portion of insulating material to be separated from the remainder of the cable. With a plurality of perforated or weakened or scored lines, applying to any of the cable uses, each of the conductor sets is capable of being separated from the remainder of the cable, independently of the other conductor sets.

Yet further, the cable can include, in addition to the series of weakened or scored or perforated lines, hereinafter referred to as perforation lines in a non limiting manner, or as an alternative to providing the same, a series of notches at predetermined, spaced intervals, are provided along the length of the cable. The notches are formed and located so as to allow a pre-determined length of insulating material to be removed from the end of a conductor set thereby leaving each of the conductor sets exposed for manipulation for joining to a plug or socket or other terminating component, without the need for use of hand tools.

In certain embodiments conventional cables are provided with shielding and in particular those cables that may be exposed to Radio Frequency Interference (RFI) and/or cables that are in close proximity to heavy inductive loads such as transformers, fluorescent lighting and the like or cables supplying the same. In addition, cables that require additional mechanical strength can be provided with shielding.

Conventionally shielding comprises metallic layers of foil, or braid wrapped around individual conductors, and/or conductor sets and/or around all of the conductors.

For the purposes of this application it is preferred that, if required, the cable and at least in the vicinity of the conductor sets, includes metallic particles, dust or liquid included therein. Typically the degree of shielding required and the type of insulating material used determines the amount of metal particles or liquid which is required to be added to the insulating material.

In a further aspect of the invention, there is provided a cable, said cable having a plurality of conductors located therealong and provided such that when the cable has no or relatively little twist, imparted along the length thereof the cable has a first level of rigidity and, when said cable has twist imparted thereon the cable, at the portion including the twist has a second, lesser level of rigidity.

Typically, the provision of the twist along at least a portion of the cable, allows, at the portion where the twist is provided, the cable to be substantially more flexible than the portions where no twist is provided on the cable.

In one embodiment, the twist which is imparted on the cable is a predefined degree of twist frequency.

In a further embodiment of the invention, the cable is twisted along the length thereof for storage purposes thereby allowing the cable to be wound around a drum with the degree of twist provided being sufficient to allow the cable to be sufficiently flexible to be wound.

In one embodiment, at the time of manufacture, the cable, having been formed in forming apparatus with the required cross section, leaves the forming apparatus to pass onto a drum onto which the same is to be stored, said drum mounted such that, in addition to rotation about a first axis to allow the cable to be wound onto the drum, the drum is also rotated about a second axis which is perpendicular to the first axis of rotation of the same.

The rotation of the drum in the second axis, means that as the cable is wound onto the drum, the cable is twisted. Typically, the speeds of rotation of the drum and the speed of introduction of the cable onto the drum are set so that the degree of twist introduced onto the cable is controlled to be within a predefined range.

In an alternative embodiment, the cable is again wound onto a drum for storage and the drum is rotated to allow the winding of the cable onto said drum and wherein provided intermediate the drum and forming apparatus, there is provided a twist mechanism through which the formed cable passes and which rotates to twist the cable to provide a required frequency degree of twist on said cable prior to being wound on the drum.

In one embodiment, the cable has a cross sectional form which is the same as any of those described in the applicant's co-pending application. In one particular embodiment, the cross section is of cross shape with each of the arms of the cross being substantially the same length and each arm having a conductor or conductor pair passing along the same.

In whichever configuration, the cable typically comprises a plurality of conductor pairs passing along the length of the same.

In one embodiment, the material which is used to form the body of the cable is known as a thermoplastic elastomer (tpe).

In one embodiment, the material used is either of products manufactured by the company LaPorte under reference numbers TR022NAT or TS5124NAT4240.

In a further aspect of the invention there is provided apparatus for forming a cable, said cable comprising a series of conductor sets passing along the length of said cable, each conductor set provided a spaced distance from the other conductor sets of the cable, said conductor sets held in the required configuration by a cable body and wherein the apparatus comprises a first part for guiding the conductor sets towards a forming location, with the conductors presented in the required configuration, and a second part which allows material in a plastic flowable state to be introduced at the forming station with the plastics material extruded from the die head in conjunction with the conductor sets held in the required configuration to form the cable.

In one embodiment, the plastics material is introduced in a flowable form into a cavity, in the form of a melt annulus within the die head, through which the conductor sets pass, said conductor sets and plastics material leaving the said cavity as an extruded length to pass through the die tip to form a cable of a desired cross section with the conductor sets maintained in the required configuration along said extruded length by use of a mandrel.

Typically the outer dimension and shape of the cable is determined by the forming die tip/plate which is located at the front of the forming station and through which the plastics material flows and along which the conductor sets pass.

Typically, the movement of the conductor sets through the forming station is controlled in conjunction with the flow rate of the plastics material as it enters the die head.

Typically the size of the die head and other parameters of the forming operation are controlled so as to allow subsequent shrinkage or possible deformation of the body material to be taken into account.

In a further aspect of the invention there is provided a cable comprising a plurality of elongate conductors held in a designated configuration along the length of the cable and said conductors are arranged in sets, the said conductors in each set being twisted about one another with the degree of twist of each set substantially the same and wherein at least one set of conductors is arranged with respect to the other sets such that the phase of the twist in that set is offset along the longitudinal axis of the cable with respect to at least one of the other conductor sets.

Typically two conductors are provided in each conductor set. In one embodiment the offset distance is half the length of one complete twist in each conductor set. In one embodiment each set of conductors is offset with respect to the adjacent conductor sets.

In a yet further aspect of the invention there is provided a cable, said cable having a plurality of conductors arranged to run along the length thereof and arranged in a predefined configuration and held therein by an insulating material which forms the cable body and wherein the cable body includes at least one protrusion, spacer arm or other means for spacing the cable body from another cable body or article, which acts as a spacer to space the cable body from another cable body or article.

In one embodiment the cable includes a series of protrusions, which in one embodiment run along the length of the cable.

In a yet further aspect of the invention there is provided a method of forming a plurality of conductor lengths into a twisted configuration, said method comprising the steps of placing said conductor lengths to form a set in a parallel relationship and, introducing a twist into said plurality of conductor lengths so as to provide the same with a required twist density and wherein, following the introduction of twist the twist is maintained and the conductor set is encapsulated by a material to retain the conductor lengths in the twisted relationship.

In one embodiment, the material which is used is a plastics material such as PVC and is provided of a sufficient strength and rigidity so as to maintain the twist of the conductor lengths once encapsulated within the plastic material.

Typically the method includes the further steps of bringing together a series of said conductor sets, each of the conductors in a set being provided in a twisted configuration with regard to at least one other conductor length and then a series of said sets are brought together to form a cable comprising a series of conductor sets.

In one embodiment, each conductor set includes two conductors twisted with respect to each other and encapsulated by the material to maintain the twisted arrangement therein prior to bringing together a series of said sets for formation of the cable. The encapsulation can occur immediately after twisting or at any stage prior to joining the conductor sets together to form the cable. The reference to encapsulation should be appreciated to include the whole or partial enclosure of the conductor sets with the material.

By providing for the encapsulation of the conductors in a set once the twist has been provided therein, so the performance of the conductors in each set can be more accurately maintained and predicted and can be maintained during the cable manufacturing process and subsequent use of the cable so formed.

In a further aspect of the invention there is provided a conductor set, said conductor set including at least two conductor lengths provided in a mutual twisted configuration and wherein, when twisted, the conductor lengths are encapsulated in a material to retain the twist in the conductor set.

In a further aspect of the invention there is provided a cable formed of a series of conductor sets, at least one of said conductor sets being encapsulated with a material to retain the configuration of the conductors in said conductor set.

BRIEF DESCRIPTION OF THE DRAWINGS

Specific embodiments of the invention are now described with reference to the accompanying drawings, wherein:—

Prior Art FIG. A1 illustrates a prior art arrangement of a conductor set;

Figure 1A:
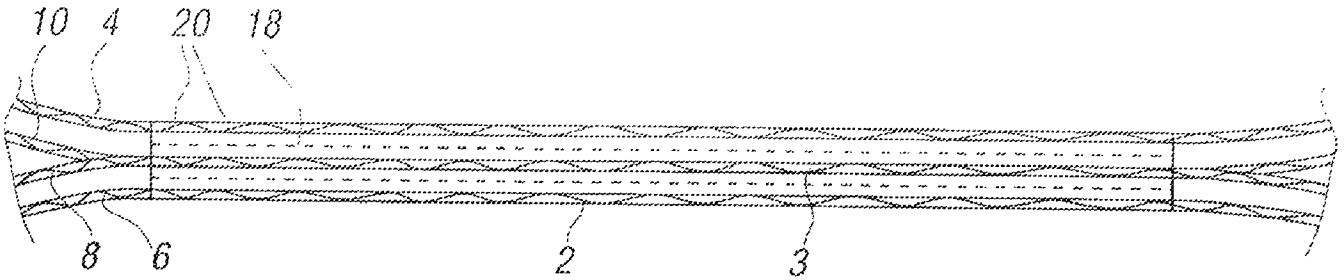
Figure 2:
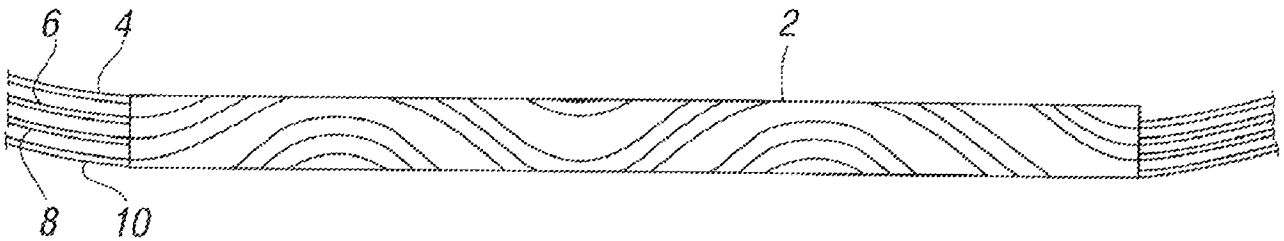
Figure 3:
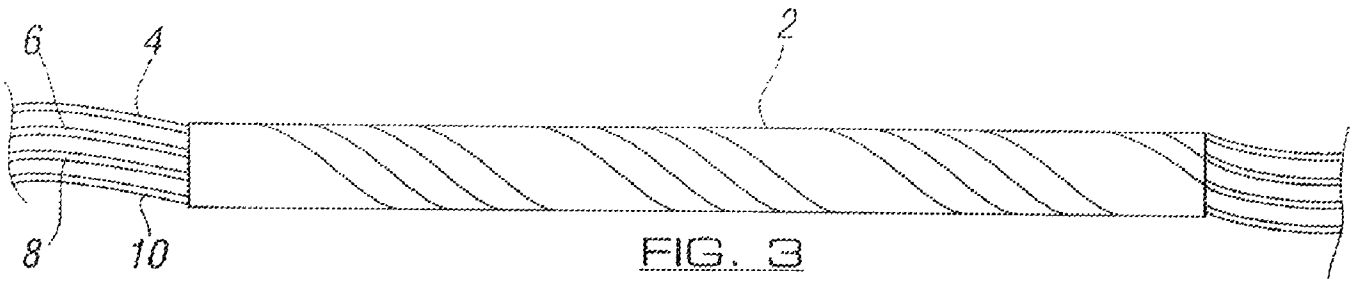
Figure 5:
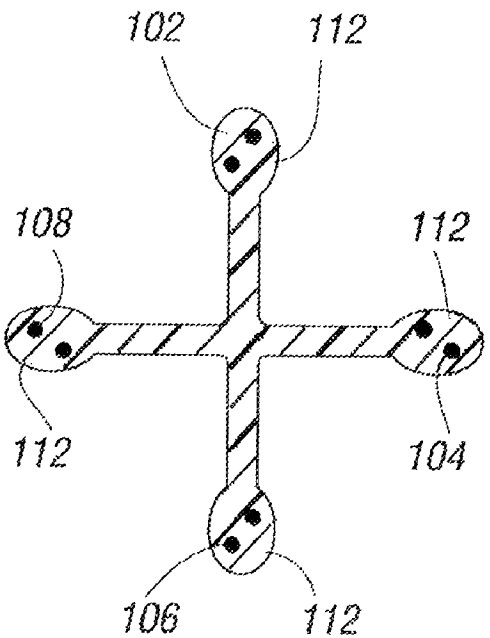
Figure 4:
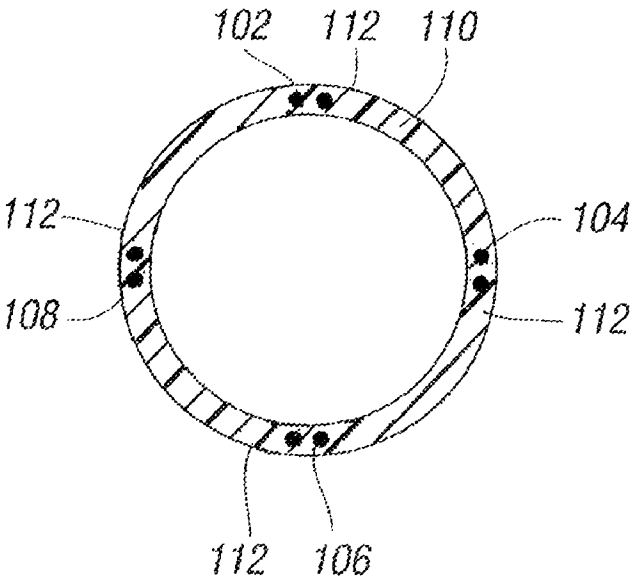

Prior Art FIG. A2 illustrates a damaged conductor set;

Prior Art FIG. B illustrates a prior arrangement for forming a cable from a plurality of conductor sets;

FIGS. 1*a* and *b* illustrate one embodiment of a cable in accordance with the invention;

FIG. 2 illustrates a further embodiment of a cable in accordance with the invention;

FIG. 3 illustrates a yet further embodiment of a cable in accordance with the invention;

FIGS. 4 and 5 illustrate further embodiments of the invention.

Figure 15:
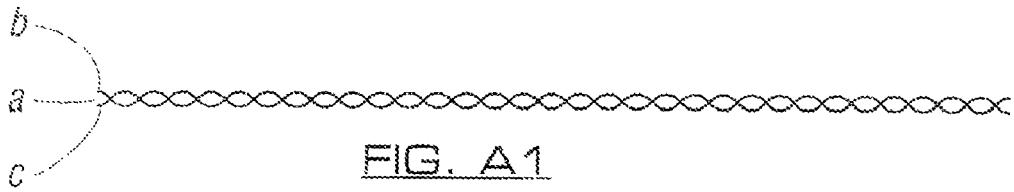
Figure 15:
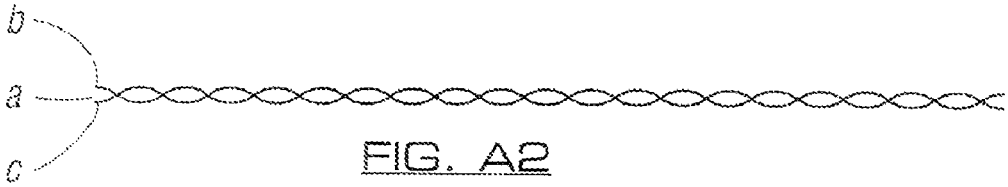
Figure 15:
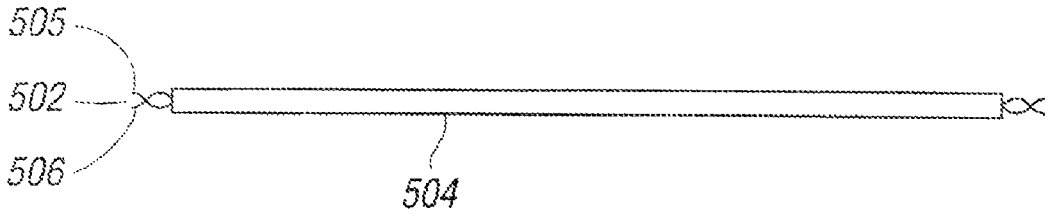
Figure 8:
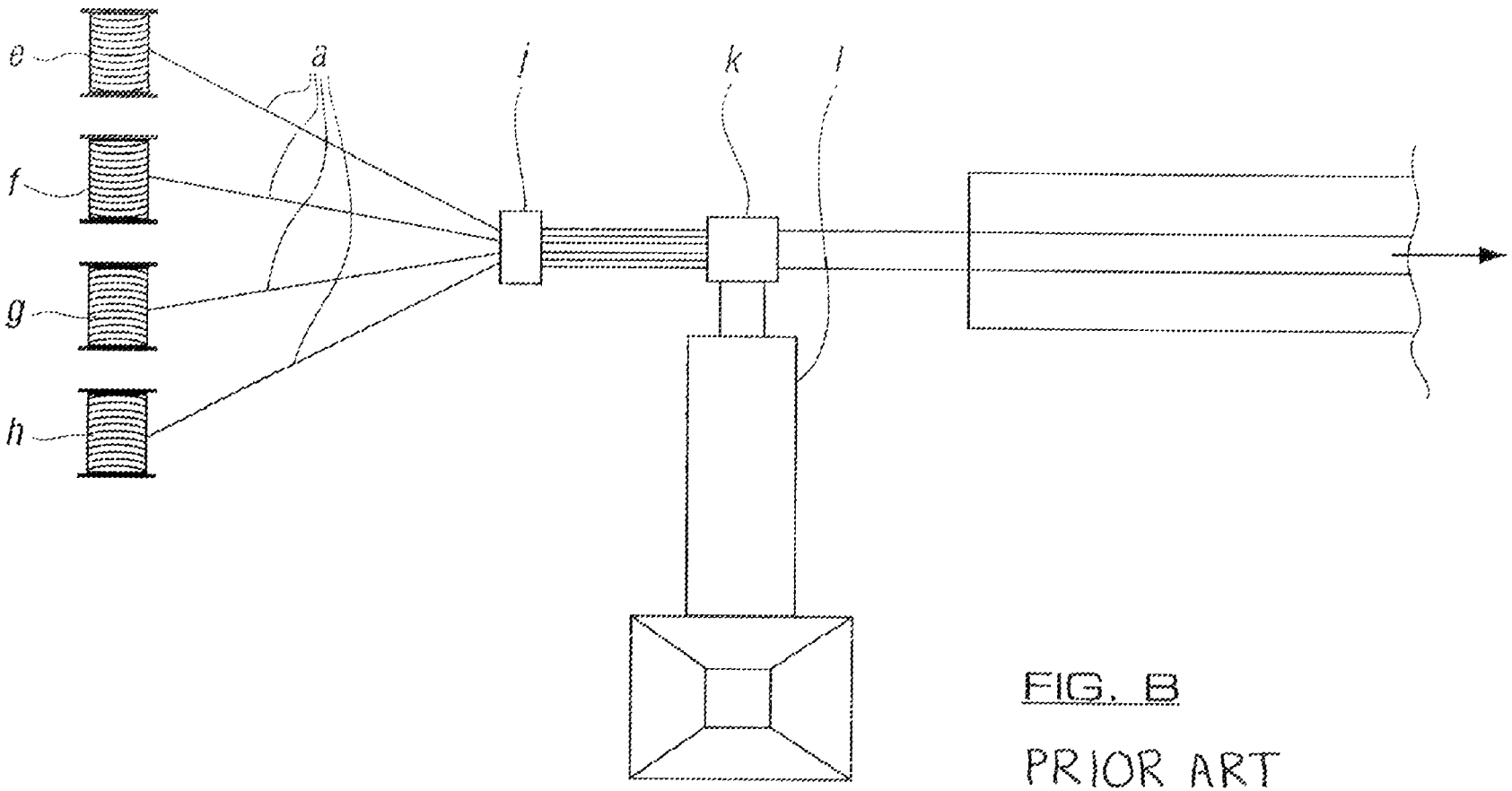
FIG. 8 PRIOR ART
Figures 6A, 6B:
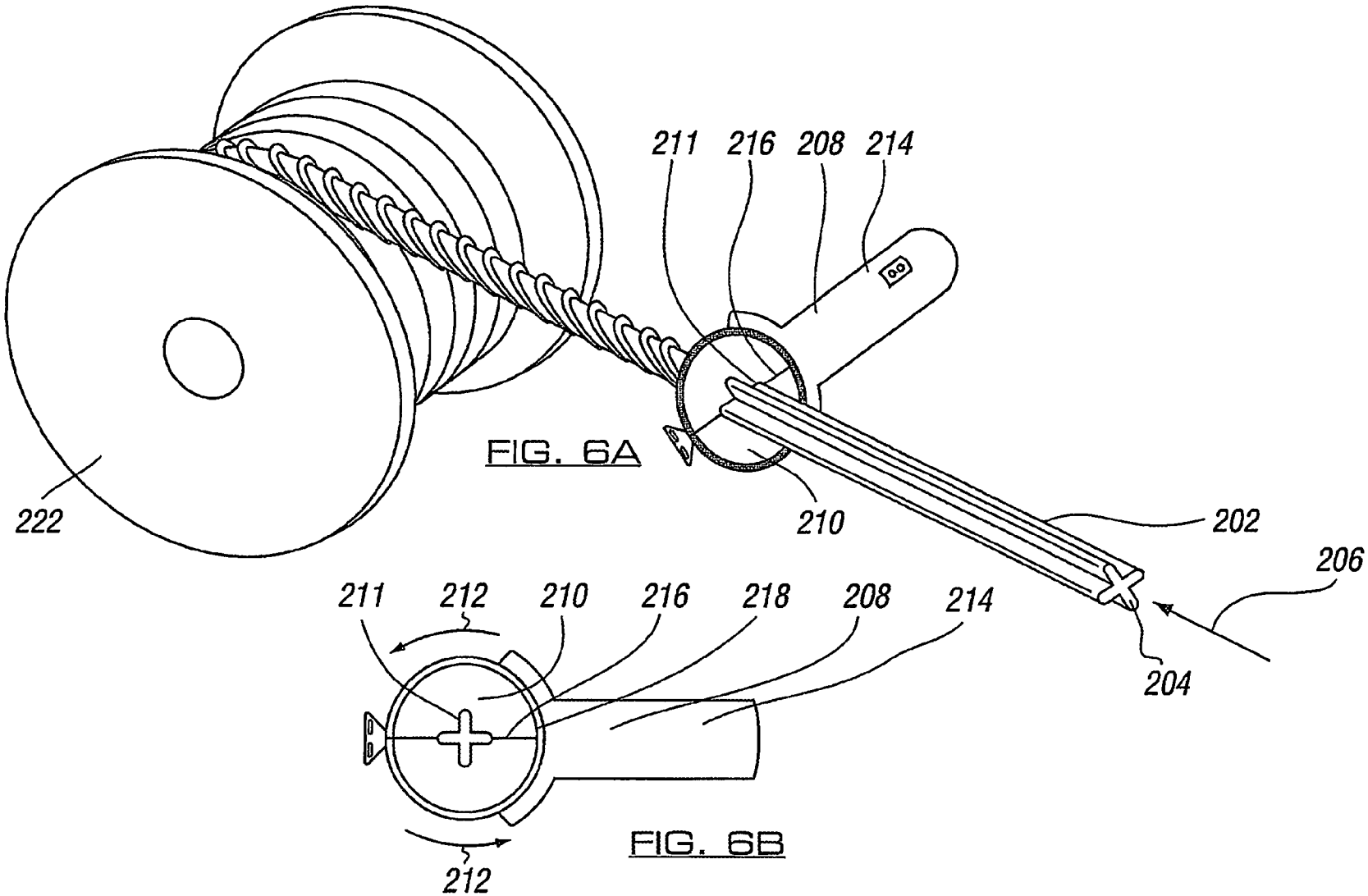
Figure 7A:
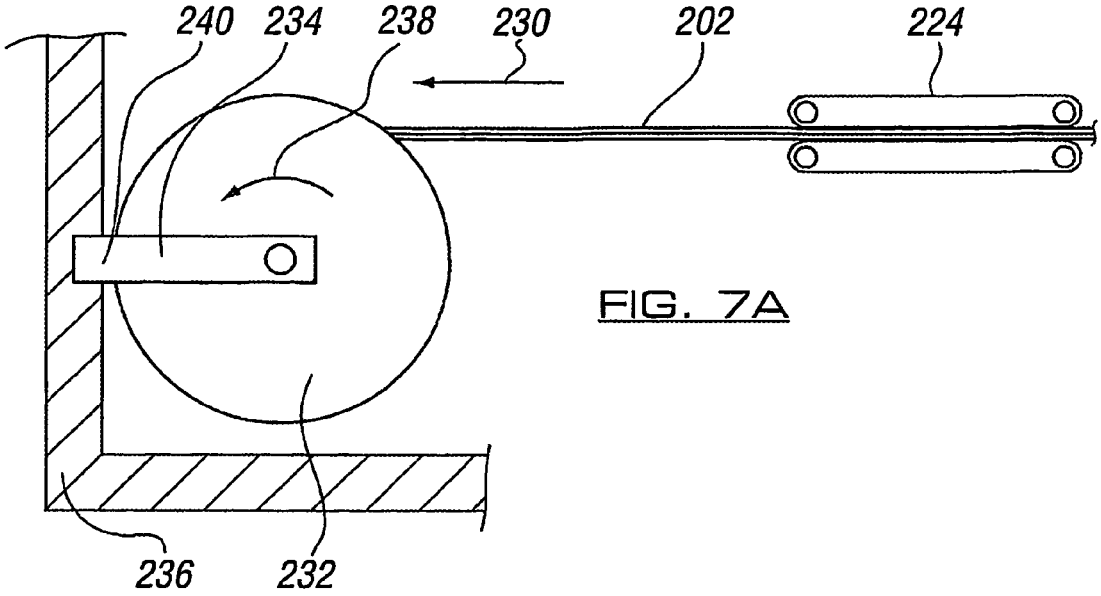
Figure 7B:
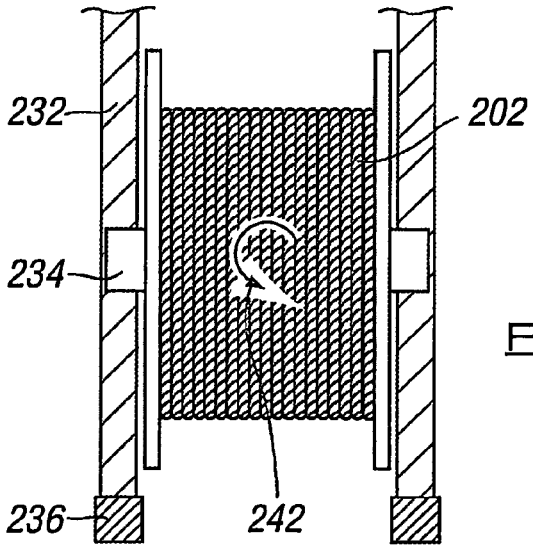
Figure 8A:
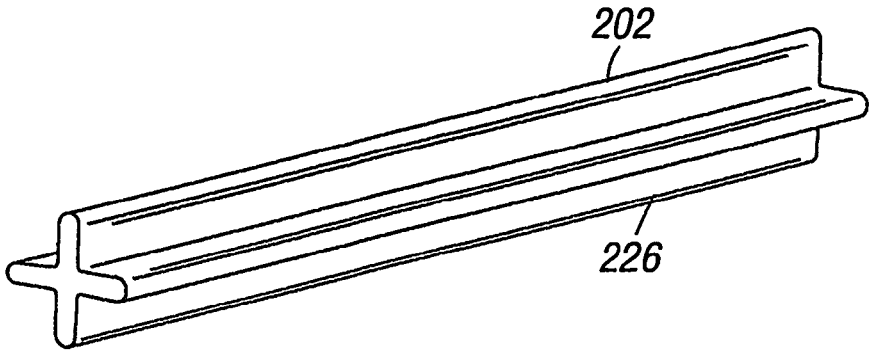
Figure 9:
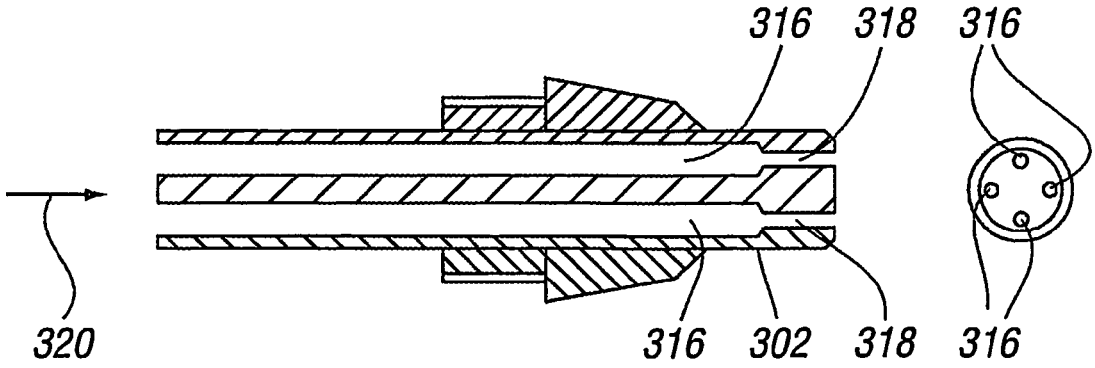
Figure 10:
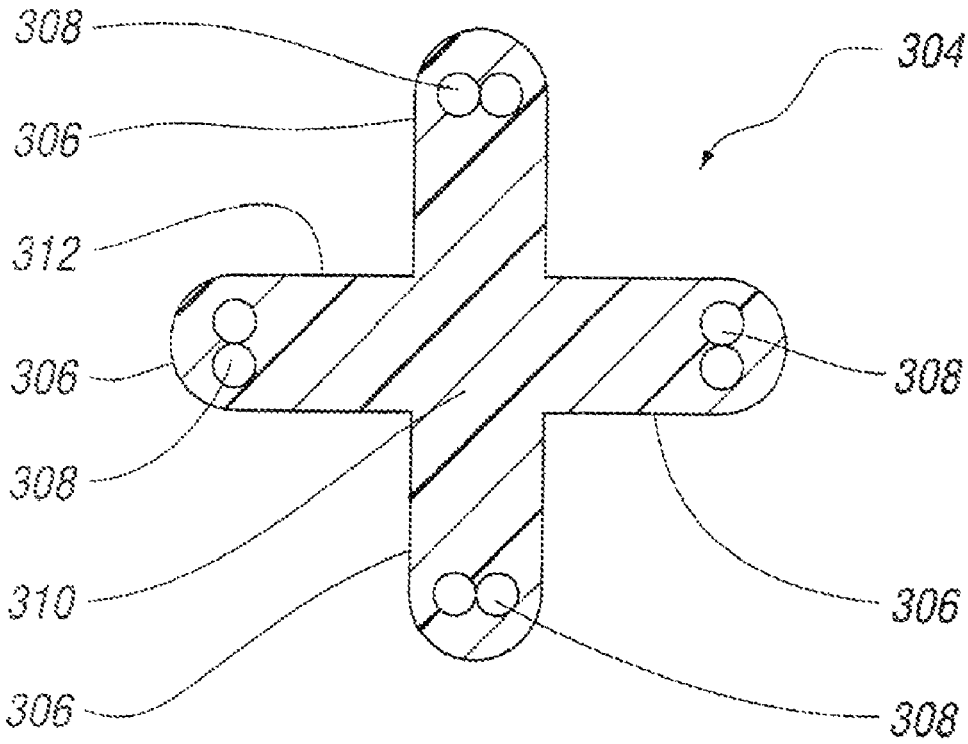
Figure 11:
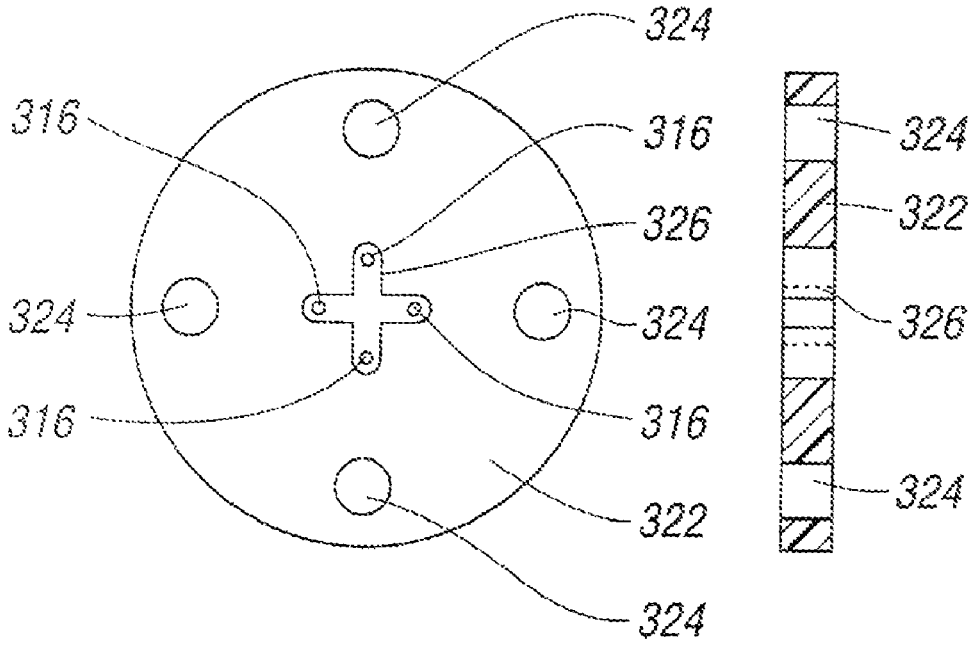
Figure 12B:
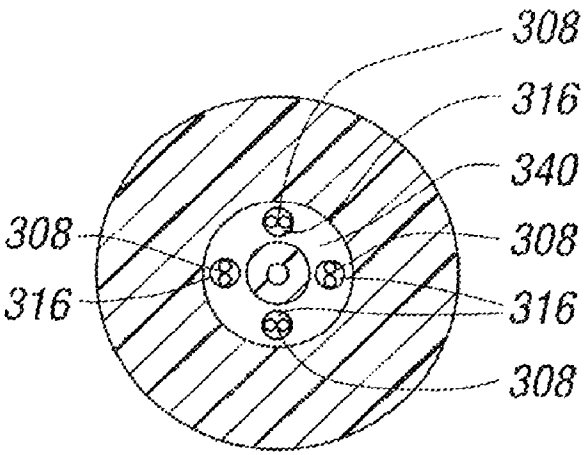
Figure 12A:
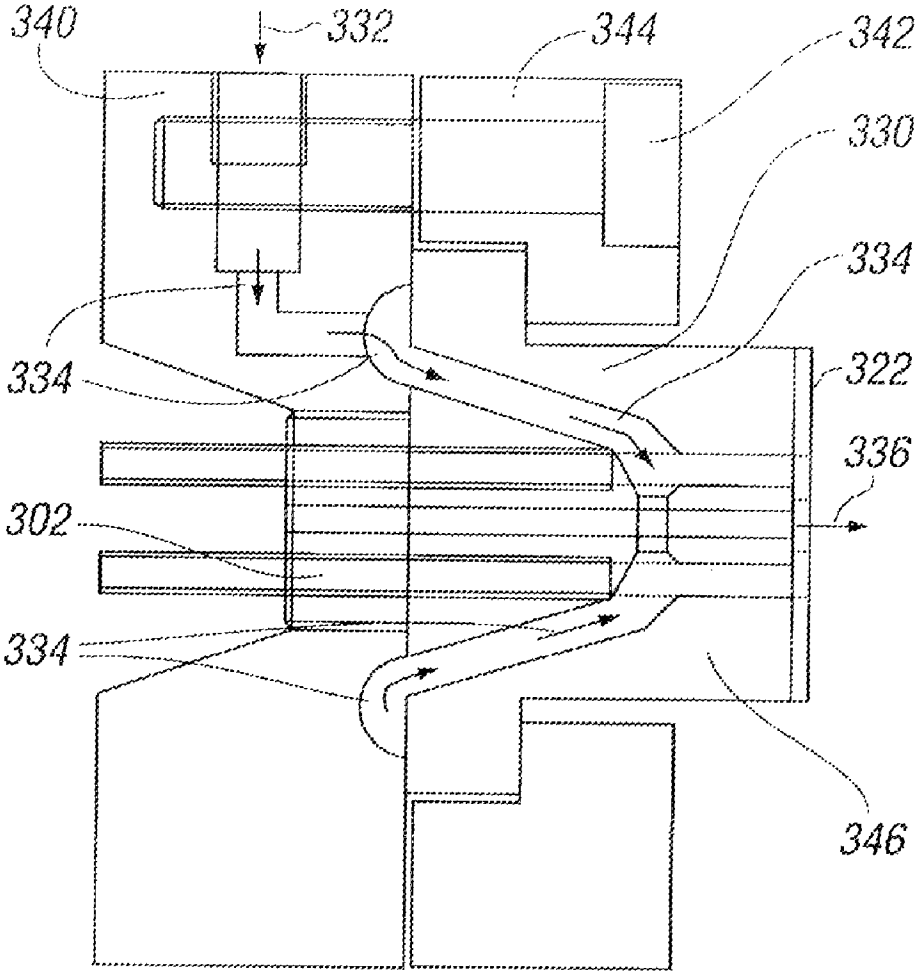
Figure 13A:
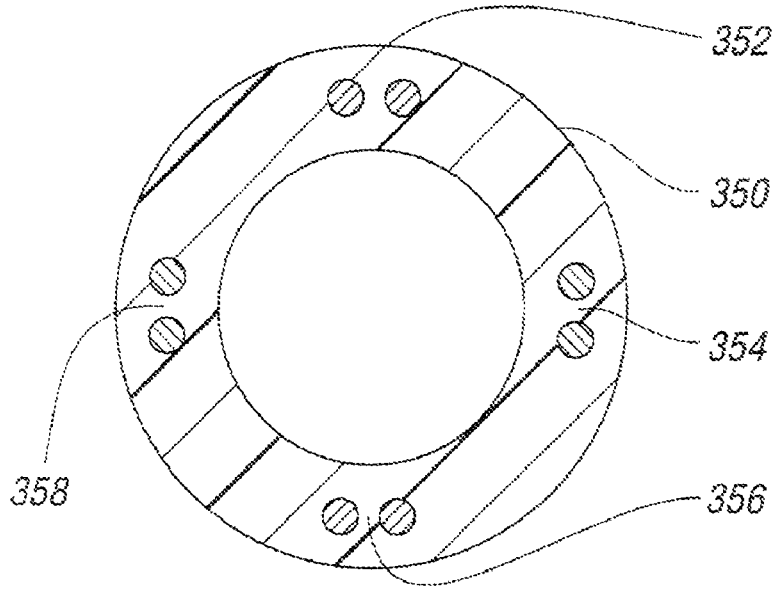
Figure 13B:
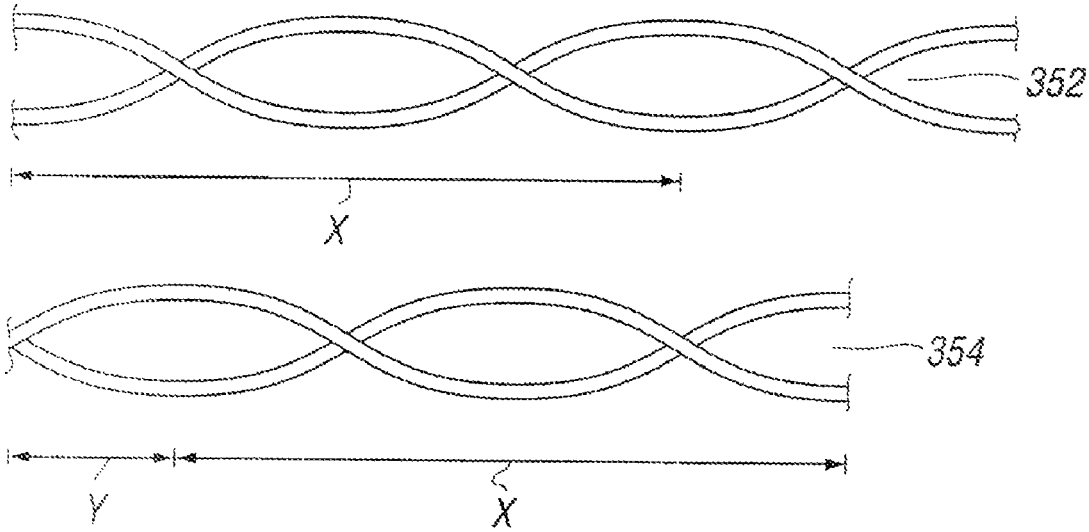
Figure 14A:
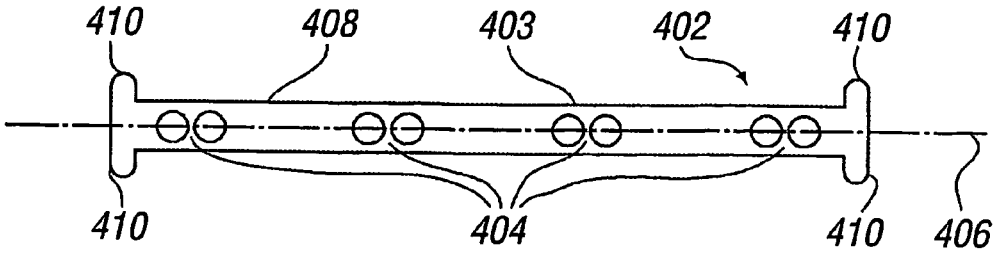
Figure 14B:
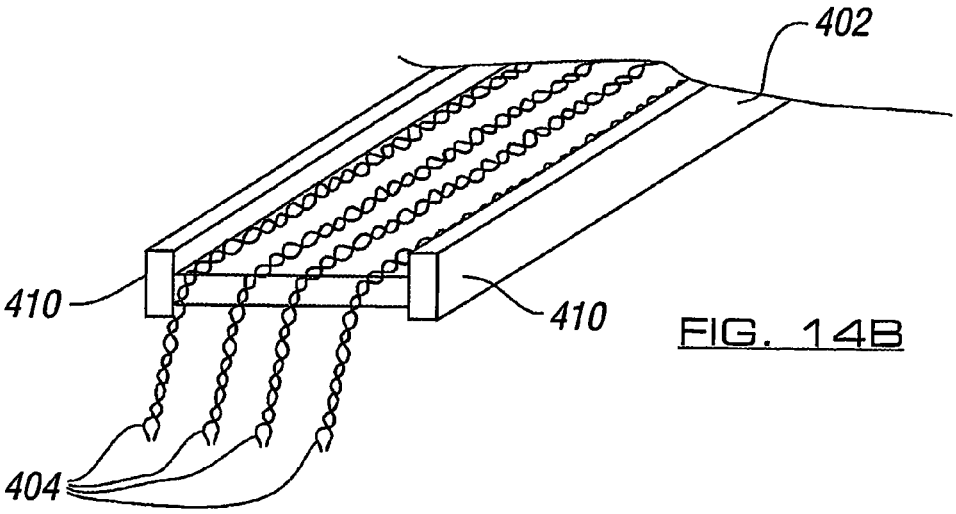
Figure 14C:
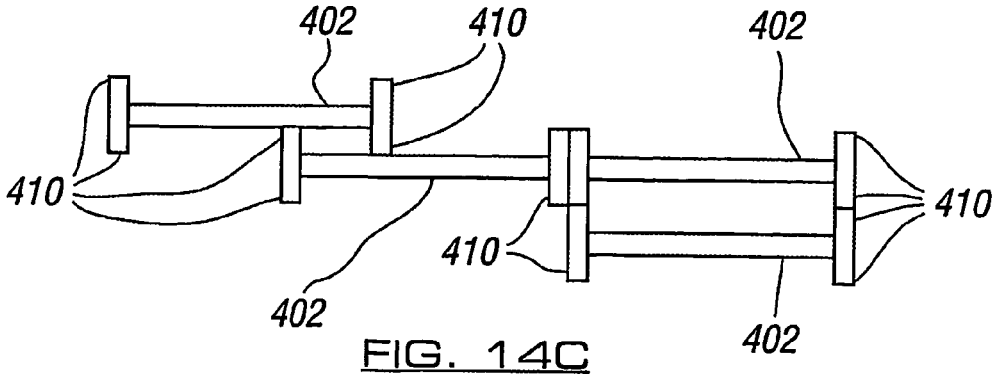
Figure 16:
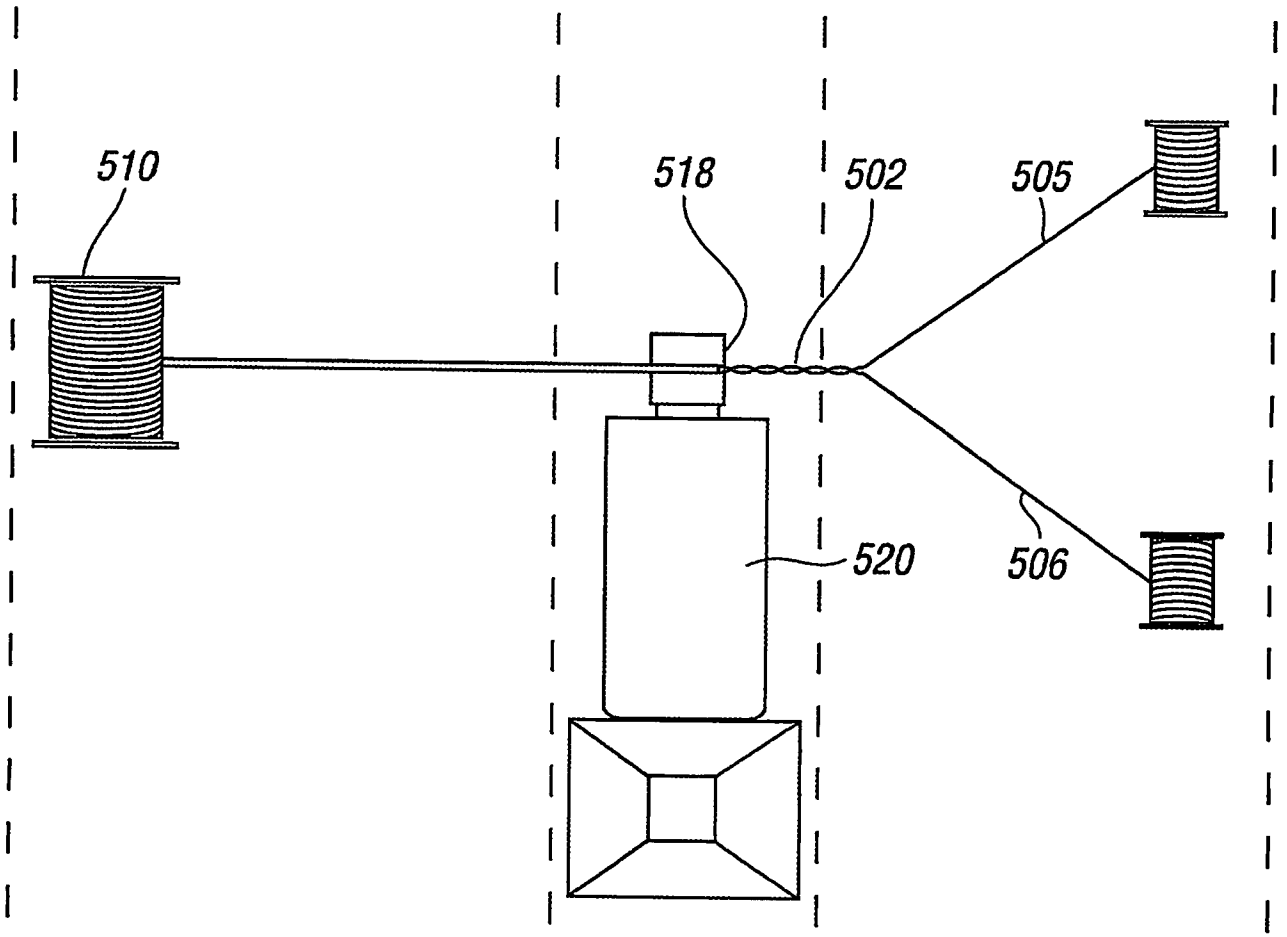

FIGS. 6*a* and *b* illustrate a further aspect of the invention;

FIGS. 7*a* and *b* illustrate a further embodiment of the invention;

FIGS. 8*a* and *b* illustrate a length of cable in accordance with the invention into selectable configurations;

FIG. 9 illustrates one embodiment of a mandrel used for the guidance of the conductor sets of the cable;

FIG. 10 illustrates a cross sectional elevation of a cable in one embodiment of the invention;

FIG. 11 illustrates a view of a die plate with a die tip of cross section to form the cable formation of FIG. 10;

FIGS. 12*a* and *b* illustrates the forming die head and a further example of a die tip in accordance with the invention;

FIGS. 13*a-b* illustrate an improvement to a cable formation in accordance with the invention;

FIGS. 14*a-c* illustrate a yet further improvement to a cable formation;

FIG. 15 illustrates a conductor set formed in accordance with one embodiment of the invention; and FIG. 16 illustrates a possible apparatus set up for use in forming a cable utilising conductor sets formed in accordance with the invention.

BRIEF DESCRIPTION OF THE PREFERRED EMBODIMENTS

Referring firstly to FIGS. 1*a* and *b*, there is provided a first embodiment of a cable in accordance with the invention.

Figure 1B:
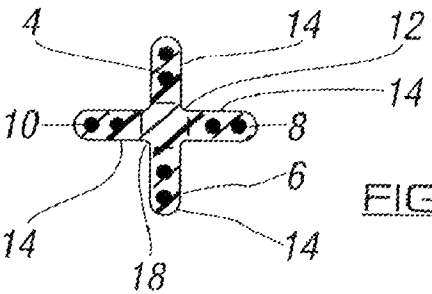

The cable 2 comprises a cable body 3 with an integral series of, in this case, four, sets of conductors, 4, 6, 8, 10, (but more or less sets can be used as desired), each set including at least two conductors, and in each set the conductors are twisted together at a given degree of twist. If required, the degree of twist can vary from set to set, particularly if space is at a premium, (greater twist densities between sets reduces crosstalk between pairs which are at close proximity to one another) and hence minimise the occurrence of cross talk. In this embodiment, the cross-sectional shape of the cable is in the form of an X as illustrated in FIG. 1*b* although it should be appreciated that virtually any other cross sectional configuration can be used. The conductor sets are integrated into the cable by being embedded in insulating material 12 with each conductor set located in a limb 14 of the cable. Thereby each conductor set is encapsulated in its own insulating material.

When being formed, the insulating material 12 is extruded, with the conductor sets being fed into the extrusion machinery at a speed so as to ensure that the conductor sets have a substantially linear path as illustrated and at a location to ensure that the same are located in substantially the same position with respect to the insulating material along the length of the cable.

Any type of material can be used although preferably an insulating material and the insulating material which is selected will be a suitable material for the application in terms of subsequent flexibility and sufficient rigidity to ensure the spacing of the conductor sets, and of the cable, insulating quality and therefore can be selected accordingly.

In addition to the advantages provided by extruding the cable with the conductors embedded therein, a series of perforations 18 are also provided.

Each perforation allows the separation, typically at an end of the cable, of one or a number of conductor sets, separately, from the cable body. This allows each conductor set to be separated which may be achieved without the use of hand tools.

In addition, a series of weakened lines or notches 20 are provided at spaced intervals along the length of the cable. The notches are typically formed as the cable is extruded and while the insulating material is still fluid. The provision of these notches means that the insulating material can be selectively removed from the conductor sets thereby exposing the conductor sets for subsequent termination at the plugs or sockets as required.

In this embodiment therefore, the cable improves the quality of data or energy transfer, decreases the duration and skill level required by installers when terminating the cable to plugs or sockets and removes the need for most hand tools to be used to terminate the cable with plugs or sockets as is explained below.

The provision of the perforations placed between the twisted pairs of conductor sets assist in separating the conductor sets in readiness for the termination and further, the indentation or notches at intervals assist in the exposure of the conductor pairs ready for termination. Thus, the necessity for hand tools is avoided which, due to predetermined distances, will reduce installer error which can reduce the performance of the cable such as, for example, by untwisting a conductor too far can lead to poor performance characteristics and hence less than optimum performance. Installer error when using a tool can also reduce the cross sectional area of the copper conductor by cutting into it in error, hence allowing increased resistivity which can lead to greater attenuation. Furthermore, by controlling the amount of insulation which is required to be removed, the possibility of the conductors in each set untwisting over a significant distance (which can cause degradation in performance), is significantly reduced.

FIGS. 2 and 3 illustrate alternative embodiments of the invention wherein the conductor sets 4, 6, 8 and 10, rather than being provided in a straight linear path, are provided in respective oscillating paths in FIG. 2 and a spiral path in FIG. 3. However, the conductor sets are still extruded in conjunction with the insulating material and therefore provide the advantages as already described, but with the likelihood of decreased alien cross talk, i.e cross talk between neighbouring cables.

In whichever embodiment, depending on the size of cable and conductor set spacing, it may still be preferred that the degree of twist in conductors in each conductor set, is controlled such that a degree of twist in one conductor set may vary from the degrees of twist of the other conductor sets such that the degree of twist between conductor sets varies.

Preferably, the conductors, when positioned within the extruded material, are positioned such that each conductor set lies as far as practicably possible away from adjacent sets. In one embodiment such as that shown in FIGS. 1*a* and *b*, a further conductor set could be accommodated at the intersection of the limbs, i.e. along the centre line of the cable. Also, this intersection could be used for a draw wire, fibre cores, energy, video, audio services etc. If permissible and installation space is not at a premium it is possible to use twisted pairs of the same twist density in the tube wall. Typically the tube wall will be greater in cross sectional area to obtain optimum performance.

In further embodiments, it may be possible to have certain conductor sets extruded with the cable insulating material and then have yet further conductor sets wound around the outside of the insulating material which has been extruded, thereby using the same as a core of the cable.

As with the previous patent application, the spacing of the conductor sets, the type of insulation material that is used to coat the single conductors in each conductor set and the type of insulation material that is used to reduce cross talk between the conductor sets themselves, and the consistency of the spacing between the conductor sets, can all have an impact on the bandwidth and performance of the cable.

The provision of the arrangement of conductor sets as illustrated in FIG. 2, allows alien cross talk to be reduced by providing an oscillating or wave-like effect along the length of the cable and similarly, the arrangement of FIG. 3, whereby the conductor sets make complete revolutions of the cable can also improve performance by the fact that the conductor sets are continually changing their position along the length of the cable.

With respect to audio, video and mains usage of the cable, when utilising two or more conduction paths, each defined by a conductor set, then a longer length of conductor material is used to allow greater resistivity with respect to the other. It is perceived that when larger currents/lower frequencies are transmitted through a shorter conductor then the smaller currents/higher frequencies will occupy the longer conduction path thus effectively separating the signals between the upper and lower frequencies. This can reduce magnetic interaction and, due to higher frequencies being faster in transmission, i.e small wave form and taking the longer conductive path, the signals will re-emerge at the receiving end in unison, undistorted and undisturbed by lower frequencies.

Referring now to FIGS. 4 and 5 there is illustrated two further embodiments of the invention, both of which incorporate a shielding feature therein to suit certain cable requirements. In FIGS. 4 and 5 the conductor sets 102, 104, 106, 108 are shown located and embedded in the insulating material 110. In both cases, in addition to the insulating material metallic particles or liquid 112 has been added so as to be extruded along with the insulating material. In this case, the metallic material has been added adjacent the conductor sets

102, 104, 106, 108, but equally could simply be added so as to be present throughout the insulating material. The extent and percentage of metallic material to insulating material is determined in accordance with specific cable requirements.

By using the above method the insulation surrounding the conductors is converted into a shield/screen by default and the amount of conductor exposure is fully controllable. Furthermore by using the perforations to detach conductor sets ends so the need to remove the standard screening foil is removed.

Referring now to FIGS. 6*a* and *b*, there is illustrated apparatus for use in the formation of cable in a configuration in accordance with the invention. In this embodiment, the cable 202 is of a cross shaped cross section 204. The cable is emitted from the apparatus 206 in the required cross sectional form and has a series of conductors embedded within an outer body material. As the cable passes from the apparatus it passes through a twist former 208. The twist former includes a holding portion 210 which has an aperture 211 passing therethrough which is of a similar shape to the chosen cross section of the cable 202. This holder 210 receives the cable to pass therethrough and rotates as indicated by arrow 212 with respect to the carrier 214. The speed of rotation can be varied to provide the required degree of twist and/or with respect to differences in the speed of the apparatus which forms the cable.

In one embodiment, the housing is provided with a split line 216 which allows the same to be opened around pivot point 218 to allow the fitment of the cable therein.

Thus, with the rotation of the housing, the cable can be twisted and therefore wound onto the drum 222 in a twist configuration which provides sufficient flexibility to the cable so as to allow the same to be effectively wound and stored on the drum.

FIGS. 7*a* and *b* illustrate an alternative embodiment where there is again provided extrusion apparatus 224 to form the cable 202 into the required configuration and the cable leaves the said apparatus in the direction of arrow 230 towards a cable drum 232. The cable drum is mounted on a U-shaped bracket 234 which in turn is mounted on a frame 236. The bracket is provided with drive means (not shown) which firstly allow the drum to rotate as indicated by arrow 238 to allow the cable to be wound onto the drum 232. However, at the same time, the drum is provided to be rotatable about a second pivotal axis 240 and as indicated by arrow 242 such that the drum rotates in the axis substantially perpendicular to the first axis of rotation so as to induce twist into the cable as it is wound onto the drum. Again, the speed of rotation about both axes and the speeds of the cable leaving the forming apparatus, can be selected to provide the required degree of twist onto the cable.

Once the cable has been subsequently removed from the drum for installation, the provision of a selective twist onto the cable can have further use to considerable advantage. When one considers the installation of a cable, it will be appreciated that the cable is typically required to pass in a relatively straight line for a significant period of time and then at other times, may be required to be bent to pass around bends, corners or the like. Thus, when the cable is required to be along a straight path, it is of advantage for the cable to be relatively rigid so as to allow the same to be guided on that straight path. In accordance with the invention, by providing the cable 202 with a straight portion 226, as shown in FIG. 8*a*, then the cable will be relatively rigid as there is no twist on the cable. This would, for example, allow the cable to be threaded through a blind port where previously conventional cable which is more susceptible to bending, may become snagged.

Figure 8B:
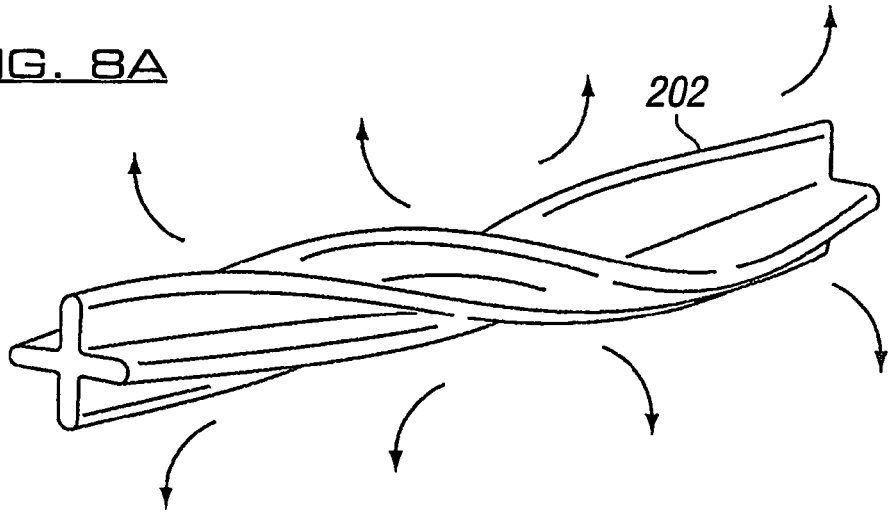

Equally however, where it is of advantage to have the cable bendable and the cable can be twisted at the required location so as to reduce the rigidity of the cable and allow the same to be bent around the required path as indicated in FIG. 8*b*.

Thus the introduction of a twist makes the cable very flexible at that portion and also assists in the reduction of alien cross talk when installed with other cables, for example, in a trunking, conduit, duct and the like.

In experimentation with differing materials used to form the body of the cable, various 'states' of the cables form have been monitored and recorded.

Using TPE (Thermo-Plastic Elastomer) or other similar substances the design takes on a feature whereby the user can change the state of the cable at will. At production stage if the cable is twisted before it goes on a drum it will be flexible in a form likened to conventional cables. When it is dispensed from its storage medium (for this example we will assume a drum) and ready for installation, the cable can be made stiff at any point in its length. The user can effectively 'untwist' the form, with his or her hands, and the cable will become stiff throughout that point. This can be useful for installation and for applications where a stiff member is required, for example when interconnecting adjacent equipment.

The design (if flexibility is required) is twisted at manufacture. This could include either apparatus of FIGS. 6*a-b* and 7*a-b*.

Referring now to FIG. 9, there is illustrated a mandrel guide means 302 for use in forming the cable in accordance with one aspect of the invention, in cross section. As will be seen from FIG. 10, the cable 304 configuration, in cross section, is of an X with each of the arms 306 of the X cross section including a pair of conductors 308 therein. The conductor pairs are maintained in that configuration by the plastics material 310 which forms the cable body and also acts as an insulator between the conductor sets and which also forms the outer surface 312 of the cable itself.

Returning now to FIG. 9, because there are four sets of conductor pairs to be located, the mandrel guide means in this embodiment, includes four guide passages 316, with each guide passage receiving and allowing the passage therealong of a cable conductor pair as indicated in the direction of arrow 320. The conductor sets are guided through the guide means by a controlled drive, not shown, which controls the speed at which the conductor sets are introduced into the forming station and also ensures that the speed of each of the conductor pairs is maintained constant relative to the others. The mandrel guide passages include a reduced section 318 as the conductor pairs approach the forming station so as to provide a more accurate location of the conductor pairs as the cable is formed.

Turning now to FIG. 11 there is illustrated a forming die plate 322 which includes securing means 324 and the die tip 326 itself into which the mandrel guide means 316 lead and hence through which the conductor pairs 316 pass.

Turning now to FIG. 12 there is illustrated a die head 330 in accordance with the invention with the die head including the mandrel guide means 302, as shown, the die plate 322, as shown with the die tip serving to define the external shape of the cable and also, if required, defining any elongate cavities which may be provided within the cable itself. The die plate 322 also includes the ability for the conductor pairs 308 to be introduced and maintained in their required configuration with respect to the plastics material 310. The plastics material which forms the cable body, is introduced via the melt annulus 332 within the die head as shown and in a flowable state. In this flowable state, the plastics material moves downwardly and around the cable forming station as indicated by the arrow 334 and as it passes through, by extrusion, the forming die, so the cable is formed with the conductor sets positioned in the required configuration within the plastics material as characterised by arrow 336.

Typically the head comprises a back plate 340 and front plate 344 joined together by bolts through apertures 342. Located between the front and back plates is a die outer 346 with which the mandrel is located and to which the die plate is affixed.

It will therefore be appreciated that in accordance with this aspect of the invention, the apparatus allows the accurate maintenance of the conductor sets in the required configuration to form the cable and the plastics material also acts as an insulator between the conductor sets. The apparatus also allows the features and advantages of the cable configuration to be incorporated.

Turning to FIGS. 13*a* and *b*, there is illustrated an improvement to a cable which may, or may not, be formed in the apparatus as herein described. FIG. 13*a* illustrates a cross sectional view of one configuration of cable but it should be appreciated that this configuration is not limiting in that other configurations may be used. In this particular arrangement, four sets of cable conductor pairs are provided 352, 354, 356 and 358. It will be seen that cable pairs 352 and 356 are opposing as are cable pairs 354 and 358.

In each case, the conductors in each pair are twisted around one another as illustrated in FIG. 13*b* where the conductor pair 352 is shown and the conductor pair 354 for illustrative purposes only as will now be described. In each conductor pair, the conductors are twisted with the same degree of twist i.e. the tightness of twist is the same in each case along the length of the cable. The degree of twist is such that one complete twist of the conductor set has a length X.

However, in order to reduce the possibility of cross talk between adjacent conductor pairs and hence reduce or remove the problem of propagation delay i.e. where data is provided at a particular location at different times leads to a lack of synchronicity for example in a video display. This is achieved by using conductors sets of the same twist density and by staggering or offsetting the degree of twist between conductor pairs laying adjacently to each other reduces cross talk such that, in this example, the conductor pairs 352 and 356 which are opposing and are therefore furthest removed from each other within the cable, are provided with the same degree of twist and in the same phase. However, conductor pairs 354 and 358 which are also opposing but lie adjacent to the cable conductor pairs 352, 356, are provided with the same degree of twist as each other and as the cable pairs 352, 356 but, the conductor pairs 354 and 358 are located such that the location of twist is offset along the longitudinal axis of the cable by, in this example, half the length X, by the distance Y as indicated in FIG. 13*b*. Thus, the conductor pairs 354 and 358 are still the same twist density and hence length but are offset, with respect to the adjacent conductor pairs 352, 356. By providing this offset between adjacent conductor pairs, so it is found that cross talk is reduced and propagation problems reduced or removed.

Turning now to FIGS. 14*a* to *c*, there is illustrated a yet further aspect of the invention wherein there is provided a cable 402 which, in this case is in a substantially planer form, having a body 403 in which are located, along axis 406, a series of conductor pairs 404 spaced apart as shown for example in FIG. 14*a*. Each conductor in each pair is twisted with respect to each other as illustrated in FIG. 14*b* and then encapsulated within an insulating material 408 to form the cable. This form of cable has already been disclosed in the applicant's earlier patent application. However, in this case, the cable is provided with spacer arms 410 which in this case protrude away from axis 406 at longitudinal edges of the cable 402. These spacer arms can be used either in conjunction with spacer arms provided on another cable as shown in FIG. 14*c* to provide a spacing between respective cables or alternatively, to contact on the remainder of the cable body, as also shown in FIG. 14*c* and in whichever format, the spacer arms serve to ensure that sufficient space is maintained between conductors in adjacent cables so as to avoid the opportunity for cross talk (namely alien cross talk) to occur between conductors of different or adjacent cables. The spacer arms can be applied to any cross section of cable. For example if a X shaped cross section cable was used the tip of each protrusion/limb will be extended by at least 0.5 mm to provide the same alien cross talk reduction. In some embodiments of use a limb with a head portion, similar in shape to a 'hammer head', spacer can be used, for example in X shaped cross section cables with the conductors located in the limb and the head part additional to the limb acting as the spacer. For circular cross sectional cables a 'rib' of plastic along the length of the cable, and typically located in line with one of the conductor sets in the cable is provided. Typically in this form one rib for each conductor set can be provided.

In any of the embodiments where there is provided a central core which passes along the length of the body the core can be utilised to carry further conductors/services along a port in the core to pass along the cable. For example, a Video data cable will ideally require an additional conductor set passing along the central core to carry a 12 volt line.

A further aspect of the invention is now described with reference to prior art FIGS. A1 and A2, where there is illustrated a conductor set (a), which comprises a pair of conductors (b) (c). The conductors (b) (c) are wound or twisted around each other to form the twisted conductor set as shown. However, there is no provision for maintenance of these twist configurations other than once twisted the same are wound onto a drum. Because of this the density of twist can alter or be damaged from the required configuration of FIG. A1 to that of FIG. A2. In order to form the cable a series of drums (e,f,g,h) as shown in FIG. B illustrates a simplified conventional apparatus set up for forming a cable comprising a series of conductor sets. The drums are arranged so that the conductor sets (a) on each of the drums can be unwound at the same time and then passed into a convergence eyelet (j) which in turn leads to a die head (k) through which of the conductor pairs pass in a held configuration and an insulating material (l) is introduced to locate and retain the conductor pairs and form the outer surface of the cable. The problem with this process is that as the conductor sets (a) are pulled off the respective drums, tension is applied to the conductor sets which in turn can cause the twist and density of twist to be altered thereby altering the relationship between the respective conductor sets when passed into the cable and indeed altering the performance of each of the conductor sets.

In accordance with the invention, FIG. 15 provides for the application of a coating or encapsulating material 504 to the conductors in a conductor set 502 as shown in FIG. 15. Typically, the conductor is formed by introducing a twist to the two lengths of conductors 505, 506 as shown in FIG. 15 but the additional step is provided of applying a coating material 504 such as a plastics insulation material around the external surface of the conductor set which acts to bond the conductors together and retain the same in the required twist configuration.

It is envisaged that once formed, each of the conductor sets is again wound on a drum 510, as shown in FIG. 16 first having passed through the diehead through which the conductors pass in the twisted configuration and are brought together so as to allow the same to be encapsulated by material from an extruder 520 to form the encapsulated conductor set. The main difference in this arrangement is that the provision of the insulating material on the conductor sets prevents tension from unduly affecting the twist or density of twist in the conductor set and thereby allows the performance of the same to be maintained and the overall performance of the cable to be more accurately defined when formed.

It is therefore submitted that the invention as herein described is a significant enhancement and that significant advantages are obtained.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

The invention claimed is:

1. A cable, said cable comprising:

a plurality of conductor sets, each set including at least two conductors, said conductors in each set twisted together, the respective conductor sets are spaced apart as they pass along a length of the cable and, the conductor sets are embedded within an insulating material which forms a body of the cable to form an integral part of the cable body and wherein, in cross section, a series of extending limbs are provided, each conductor set being mounted and positioned within a different extending limb of the cable.

2. A cable according to claim 1 wherein said insulating material is extruded with said conductor sets positioned as they pass through a die head as said insulating material is extruded.

3. A cable according to claim 1 wherein said conductor sets are in a substantially linear path and in a substantially continuous configuration along the length of said cable.

4. A cable according to claim 1 wherein the respective conductor sets follow parallel paths along the length of said cable in a wave or oscillating formation along the length of said cable.

5. A cable according to claim 4 wherein an angle and/or frequency of the wave is set with respect to a particular cable design.

6. A cable according to claim 5 wherein the angle of wave or oscillation is within a range of 0.1-90°degrees.

7. A cable according to claim 1 wherein each conductor set follows a spiral path along the length of the cable.

8. A cable according to claim 7 wherein an angle and/or frequency of a spiral is set with respect to the particular cable design.

9. A cable according to claim 8 wherein the angle and/or frequency of spiral is within the range of 0.1-90° degrees.

10. A cable according to claim 1 wherein the insulating material is formed with a series of perforation lines.

11. A cable according to claim 10 wherein said perforation lines run substantially parallel with a longitudinal axis of said conductor sets and between adjacent conductor sets so as to allow, when said perforated lines are broken, a conductor set and a portion of insulating material to be separated from a remainder of said cable.

12. A cable according to claim 11 wherein each of said conductor sets is capable of being separated from the remainder of said cable, independently of the other conductor sets.

13. A cable according to claim 1 wherein said cable further includes, in addition to the series of perforated lines, a series of notches at predetermined, spaced intervals, provided along a length of the cable formed and located so as to allow a pre-determined length of insulating material to be removed from an end of a conductor set thereby leaving the conductor set exposed.

14. A cable according to claim 1 wherein the cable includes shielding in the form of any or any combination of metallic particles, dust or liquid included therein.

15. A cable, as set forth in claim 1:

such that when the cable has no or relatively little twist imparted along a length thereof, the cable has a first level of rigidity; and when said cable has twist imparted thereon the cable, at the portion including the twist, has a second, lesser level of rigidity.

16. A cable according to claim 15 wherein provision of said twist along at least a portion of said cable, allows, at the portion where said twist is provided, said cable to be substantially more flexible than a portions where no or relatively little twist is provided on said cable.

17. A cable according to claim 15 wherein said twist which is imparted on said cable is a predefined degree of twist frequency.

18. A cable according to claim 15 wherein said cable is twisted along a length thereof for storage purposes thereby allowing said cable to be wound around a drum with a degree of twist provided being sufficient to allow said cable to be sufficiently flexible to be wound.

19. A cable according to claim 18 wherein at the time of manufacture, said cable, having been formed in forming apparatus with the required cross section, leaves the forming apparatus to pass onto a drum onto which said cable is to be stored, said drum mounted such that, in addition to rotation about a first axis to allow said cable to be wound onto the drum, the drum is also rotated about a second axis which is perpendicular to the first axis of rotation of the same so that as said cable is wound onto the drum, said cable is twisted.

20. A cable according to claim 18 wherein said cable is again wound onto a drum for storage and the drum is rotated to allow the winding of said cable onto said drum and intermediate the drum and forming apparatus, there is provided a twist mechanism through which a formed cable passes and which rotates to twist said cable to provide a required frequency degree of twist on said cable prior to being wound on the drum.

21. A cable according to claim 15 wherein material which is used to form the body of said cable is a thermoplastic elastomer.

22. A cable, according to claim 1 comprising:

a plurality of elongated conductors held in a designated configuration along a length of the cable and said conductors are arranged in sets, said conductors in each set being twisted about one another with a degree of twist of each set substantially the same; and at least one set of conductors being arranged with respect to the other sets such that a phase of the twist in that set is offset along a longitudinal axis of the cable with respect to at least one of the other conductor sets.

23. A cable according to claim 22 wherein two conductors are provided in each conductor set.

24. A cable according to claim 22 wherein the offset distance is half the length of one complete twist in each conductor set.

25. A cable according to claim 24 wherein each set of conductors is offset with respect to adjacent conductor sets.

26. A cable, according to claim 1:

a plurality of conductors arranged to run along a length thereof and arranged in a predefined configuration and held therein by an insulating material which forms a cable body having at least one protrusion, spacer arm or other means for spacing the cable body from another cable body or article, which acts as a spacer to space the cable body from another cable body or article.

27. A cable as set forth in claim 1 wherein said series of extending limbs are each radially extending.

28. A cable as set forth in claim 1 wherein said series of extending limbs is in the form of a cross.

* * * * *